United States Patent [19]

Sauer

[11] Patent Number: 4,648,743

[45] Date of Patent: Mar. 10, 1987

[54] METHOD OF PRODUCING A SUBTERRANEAN STRUCTURE

[76] Inventor: Gerhard Sauer, St. Jakob/Thurn 125, A-5412 Puch/Salzburg, Austria

[21] Appl. No.: 790,470

[22] Filed: Oct. 23, 1985

[30] Foreign Application Priority Data

Nov. 26, 1984 [DE] Fed. Rep. of Germany ..... 3443040

[51] Int. Cl.[4] ..... E21D 9/00; E21D 11/00

[52] U.S. Cl. ..... 405/138; 405/132; 405/149

[58] Field of Search ..... 405/149, 132, 134, 138, 405/231, 233

[56] References Cited

U.S. PATENT DOCUMENTS

| | | | |
|---|---|---|---|
| 440,576 | 11/1890 | Radcliffe | 405/138 |
| 745,457 | 12/1903 | McBean | 405/134 X |
| 902,973 | 11/1908 | Knudsen | 405/138 |
| 2,839,271 | 6/1958 | Kandle | 405/138 |

FOREIGN PATENT DOCUMENTS

| | | | |
|---|---|---|---|
| 536193 | 3/1955 | Belgium | 405/132 |
| 340032 | 9/1921 | Fed. Rep. of Germany | 405/132 |
| 2829712 | 11/1979 | Fed. Rep. of Germany . | |
| 2138057 | 10/1984 | United Kingdom | 405/132 |
| 614167 | 7/1978 | U.S.S.R. | 405/231 |

*Primary Examiner*—Richard J. Scanlan, Jr.
*Assistant Examiner*—Todd G. Williams
*Attorney, Agent, or Firm*—Kurt Kelman

[57] ABSTRACT

In a method of producing a subterranean structure comprises the steps of excavating a ditch or hole in the ground to a desired subterranean level, placing the ceiling directly on the excavated ground at this level, filling the hole in the ground, and driving an arched tunnel into the ground below the ceiling, the ceiling is fixed in position and the ground is stabilized before the hole is filled and the arched tunnel is driven into the ground, by anchoring the ceiling with retaining elements projecting downwardly from the ceiling into the ground below, and arranging the retaining elements to form piles protecting the tunnel arch at respective sides thereof and preventing earth from crashing through the tunnel arch.

6 Claims, 2 Drawing Figures

METHOD OF PRODUCING A SUBTERRANEAN STRUCTURE

BACKGROUND OF THE INVENTION

1. Field of the Invention

The present invention relates to improvements in a method of producing a subterranean structure having a ceiling, such as a subway tunnel, which comprises the steps of excavating a ditch or hole in the ground to a desired subterranean level, placing the ceiling directly on the excavated ground at this level, filling the hole in the ground, and driving an arched tunnel into the ground below the ceiling.

2. Description of the Related Art

Such a tunnel making method is known, for example, from German Pat. No. 2,829,712. It has the advantage of doing away with usual support structures and is, therefore, very economical and efficient. This is due to the fact that the tunnel ceiling is supported simply and directly on the existing ground at the bottom of the surface excavation, the longitudinally extending edges at respective sides of the ceiling lying on the existing ground and being supported thereby. However, the method disclosed in this patent has the disadvantage that a hole of excessive width must be excavated to enable the ceiling to be placed, which is due to the fact that, at both sides of the tunnel, sufficiently wide longitudinally extending strips must be laid bare to constitute supports for the longitudinally extending edges of the ceiling. Additionally, the tunnel ceiling itself must be of a width far in excess of the width required to cover the tunnel. Furthermore, experience has shown that a ceiling installed in this manner cannot satisfactorily prevent surrounding earth from crashing through the tunnel arch.

SUMMARY OF THE INVENTION

It is the primary object of this invention to improve the described method and to avoid the indicated disadvantages thereof, particularly by reducing the width of the initial excavation and by preventing earth from crashing through the tunnel arch when the arched tunnel is driven into the ground below the ceiling.

The above and other objects are accomplished according to the invention by fixing the ceiling in position and stabilizing the ground below the level of the ceiling before the ditch or hole is filled and the arched tunnel is driven into the ground by anchoring the ceiling with retaining elements projecting downwardly from the ceiling into the ground below this level, and arranging the retaining elements to form piles protecting the tunnel arch at respective sides thereof and preventing earth from crashing through the tunnel arch.

The improved method retains the economy and efficiency of the known method because of the absence of the usual bracing supports. Above-ground traffic is halted only for the very short time required for laying the ceiling, for example by casting a concrete plate at the bottom of the excavated hole or ditch and arranging the retaining elements, for instance by injecting piles projecting downwardly from the ceiling into the ground below the level of the ceiling. The method does not require such heavy equipment as is needed in other tunnelling methods for making slotted support walls or long support piles for the tunnel ceiling, as well as installations for preparing and storing the fluid materials used to make such supports.

The method of the present invention enables the width of the excavated hole prepared for the tunnel ceiling to be reduced considerably because the ceiling itself may have a much smaller width than heretofore possible. This is due to the fact that the tunnel ceiling no longer needs to be supported on the adjoining ground along an edge strip of a predetermined width but rests essentially at its two ends on the adjoining ground and the tunnel tube completed thereafter. For this reason, too, the width of the tunnel ceiling used in the method of this invention, which conventionally was about 10 m for a 20 m long ceiling section, may be almost cut in half, i.e. a ceiling section having a length of 20 m may have a width of about 5 m. This not only considerably reduces the amount of material required for the ceiling but correspondingly reduces the excavation work required for placing the ceiling. In addition, the retaining elements vertically or preferably obliquely downwardly projecting into the adjoining ground tend to stabilize the same and prevent earth from crashing through the tunnel arch when the tunnel is driven into the ground below the ceiling. For this purpose, it is necessary or desirable only to secure the side walls of the tunnel up to the tunnel arch by suitable protective means to prevent the earth from laterally entering the tunnel. The method holds the disturbed surface above the tunnel to a minimum width while simultaneously assuring a very short construction time.

BRIEF DESCRIPTION OF THE DRAWING

The above and other objects and advantages of the present invention will become more apparent from the following detailed description of a now preferred embodiment thereof, taken in conjunction with the accompanying somewhat schematic drawing wherein.

DESCRIPTION OF THE PREFERRED EMBODIMENT

Figure 1:
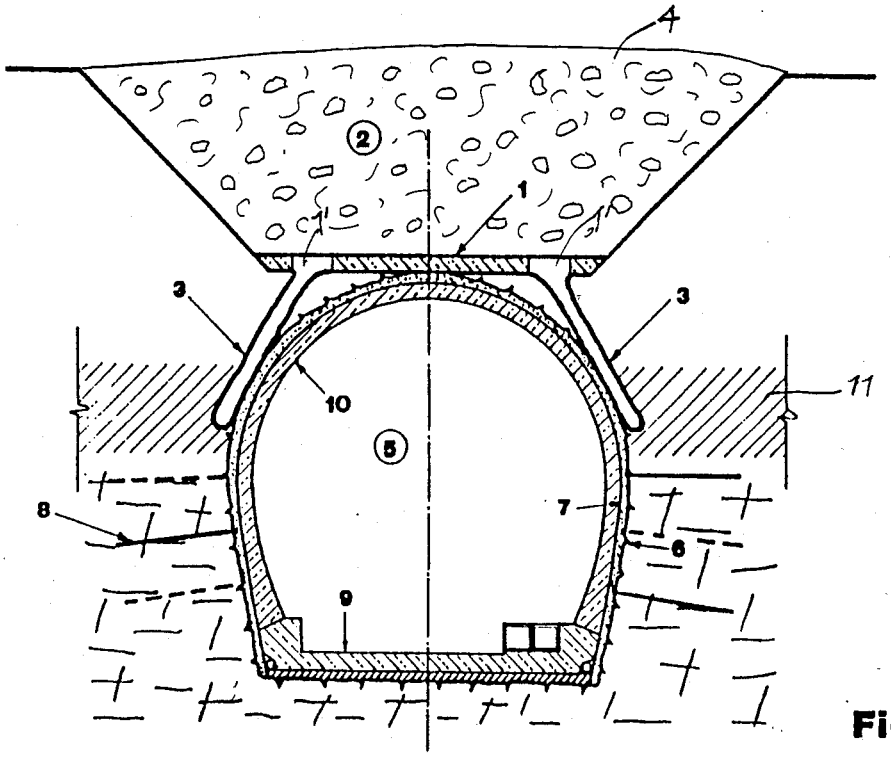
FIG. 1 shows a transverse section of a subterranean structure built in accordance with the method of this invention.

As shown in the drawing, ditch 2 is excavated in the ground to a desired subterranean level and ceiling 1 is directly placed on the bottom of the excavated ground at this level. The width of the excavated ditch at this level, as shown in FIG. 1, does not exceed the width of the ceiling i.e. the ceiling has respective longitudinal edges substantially coinciding with the longitudinal edges of the ditch bottom. This saving has become possible since it is no longer necessary to lay bare two longitudinally extending lateral strips at both sides of the tunnel tube on which the lateral edges of the tunnel ceiling are supported. Instead, as shown in FIG. 2, the relatively narrow ceiling section 1 rests for the time being on the existing ground and, after the tunnel tube has been completed, on the reinforced shell of the tunnel so that it is possible to use a ceiling of a width not exceeding that of the tunnel cross section.

After ceiling 1 has been placed on the excavated ground at the desired level, for example by casting a concrete slab, the ceiling is fixed in position and the ground below the level of the ceiling is stabilized by anchoring the ceiling with retaining elements 3 projecting downwardly from the ceiling into the ground 11 below this level, the retaining elements being arranged to form piles protecting the tunnel arch at respective sides thereof and preventing earth from crashing through the tunnel arch, as clearly illustrated in FIG. 1.

As shown in the drawing, the ceiling has respective longitudinally extending edges along the respective sides of the tunnel arch and the retaining elements are arranged to project downwardly from the edges to form a protective cap with the ceiling over the tunnel arch. If the ceiling is wide enough, this may be accomplished with retaining elements projecting vertically downwardly from the ceiling edges. However, in the preferred illustrated embodiment, retaining elements 3 are arranged to project obliquely outwardly from the ceiling edges. The retaining elements may be stakes or piles produced by injecting concrete into elongated bores in the ground, steel bolts or the like, which may be applied by simple and light-weight equipment. For this purpose, holes' may be made in the ceiling along the edges and the retaining elements are downwardly projected from the ceiling through the holes in the ceiling. Alternatively, the retaining elements may be driven through the ceiling along the edges. Retaining elements 3 may be arranged at spacings of about 0.5 to 1.5 m, which will assure a safe retention wall preventing earth from crashing through the tunnel arch.

Figure 2:
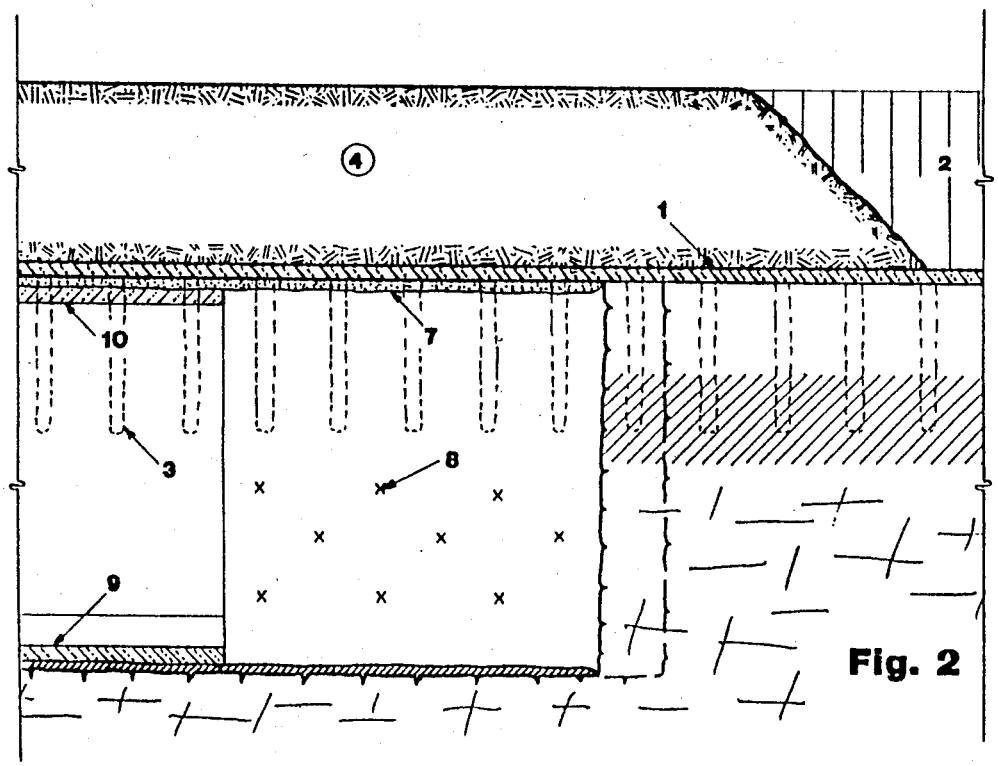
FIG. 2 is a fragmentary longitudinal section of the structure of FIG. 1.

As shown in FIG. 2, after ceiling 1 has thus been fixed in position, ditch 2 is filled with the previously excavated earth 4, whereupon arched tunnel 5 is driven into the ground below secured ceiling 1 in a suitable tunnel-boring operation. During the tunnel boring operation, retaining elements 3 prevent earth from crashing through the tunnel arch so that the operation may proceed in a most economical and efficient manner. As the tunnel driving operation proceeds, the walls of adjoining ground 6 are secured by spraying concrete over the walls to provide lining 7 and, if additional safety is desired, the tunnel lining may be held in position by anchors 8 extending into the adjoining ground. The bottom of the tunnel is also lined and then provided with concrete floor 9, and the lined tunnel walls are then provided with the usual reinforced shell 10 to produce the permanent tunnel structure.

What is claimed is:

1. A method of producing a subterranean structure with a ceiling in the ground, which comprises the sequential steps of (a) excavating a ditch in the ground to a desired subterranean level, the ditch having a bottom with respective longitudinal edges at said level, (b) placing the ceiling directly on the bottom of the excavated ditch, the ceiling having two opposite ends and respective longitudinal edges substantially coinciding with the longitudinal edges of the ditch bottom, (c) fixing the ceiling in position on the ditch bottom and stabilizing the ground below said level by anchoring the ceiling with retaining elements projecting along the longitudinal edges of the ceiling downwardly from the ceiling into the ground below said level, (d) filling the ditch, and (e) driving an arched tunnel into the ground below and along the anchored ceiling between the retaining elements, the retaining elements forming piles protecting the arched tunnel at respective sides thereof and preventing earth from crashing through the arched tunnel, the ceiling resting with its two opposite ends respective on the arched tunnel and on the existing ground, and the ceiling with the retaining elements forming a protective cap over the arched tunnel.

2. The method of claim 1, comprising the further step of introducing a reinforced shell into the arched tunnel, one of the ceiling ends being supported on the reinforced shell.

3. The method of claim 1, wherein the retaining elements are arranged to project obliquely outwardly from the ceiling edges.

4. The method of claim 1, wherein holes are made in the ceiling along the edges and the retaining elements are downwardly projected from the ceiling through the holes.

5. The method of claim 1, wherein the retaining elements are driven through the ceiling along the edges.

6. The method of claim 1, wherein the retaining elements are arranged at spacings of about 0.5 to 1.5 m.

* * * * *